US005566662A

United States Patent [19]

Messih

[11] Patent Number: 5,566,662

[45] Date of Patent: Oct. 22, 1996

[54] ENGINE AIR/FUEL CONTROL SYSTEM WITH AN ADAPTIVELY LEARNED RANGE OF AUTHORITY

[75] Inventor: Isis A. Messih, Troy, Mich.

[73] Assignee: Ford Motor Company, Dearborn, Mich.

[21] Appl. No.: 538,086

[22] Filed: Oct. 2, 1995

[51] Int. Cl.[6] ..... F02D 41/14

[52] U.S. Cl. ..... 123/674; 123/696

[58] Field of Search ..... 123/674, 675, 123/688, 694, 695, 696

[56] References Cited

U.S. PATENT DOCUMENTS

| | | | |
|---|---|---|---|
| 4,528,962 | 7/1985 | Auth | 123/696 |
| 4,638,658 | 1/1987 | Otobe | 73/117.3 |
| 4,747,385 | 5/1988 | Abe | 123/674 |
| 5,001,643 | 3/1991 | Domino et al. | 123/674 |
| 5,053,968 | 10/1991 | Uchinami | 123/674 |
| 5,070,847 | 12/1991 | Akiyama et al. | 123/674 |
| 5,094,214 | 3/1992 | Kotzan | 123/479 |
| 5,158,062 | 10/1992 | Chen | 123/674 |
| 5,239,975 | 8/1993 | Mallebrein et al. | 123/696 |
| 5,263,464 | 11/1993 | Yoshida et al. | 123/696 |
| 5,305,727 | 4/1994 | Gopp | 123/688 |
| 5,320,080 | 6/1994 | Kadowaki | 123/674 |
| 5,464,000 | 11/1995 | Pursifull et al. | 123/674 |
| 5,467,755 | 11/1995 | Konrad et al. | 123/674 |
| 5,503,134 | 4/1996 | Delosh et al. | 123/696 |

*Primary Examiner*—Willis R. Wolfe
*Attorney, Agent, or Firm*—Allan J. Lippa

[57] ABSTRACT

An engine air/fuel control system is disclosed having one feedback correction loop generating a feedback variable by essentially integrating the output of an exhaust gas oxygen sensor. A second feedback loop adaptively learns a feedback correction from the difference between the feedback variable and its desired value such as unity. A range of authority for the total air/fuel controller is adaptively learned from the learned correction value to maximize the correction which may be applied by the feedback variable under all operating conditions.

8 Claims, 4 Drawing Sheets

ENGINE AIR/FUEL CONTROL SYSTEM WITH AN ADAPTIVELY LEARNED RANGE OF AUTHORITY

FIELD OF THE INVENTION

The present invention relates to engine air/fuel control systems.

BACKGROUND OF THE INVENTION

Engine air/fuel feedback control systems are known in which a feedback variable derived from an exhaust gas oxygen sensor trims fuel flow to the engine in an effort to maintain desired air/fuel operation. Typically, the feedback variable is limited to fixed upper and lower limits thereby providing a range of authority for air/fuel feedback control. It is also known to provide an adaptively learned feedback correction term or variable derived from a difference between the feedback variable and its desired value. Such a system is disclosed in the U.S. Pat. No. 5,158,062.

The inventors herein have recognized numerous problems with the above approaches. One problem is that the range of authority of the feedback control system is defined by fixed limits of the feedback variable. Under certain operating conditions, wherein the feedback correction term has not reached its mature value, the feedback variable will be prematurely limited.

SUMMARY OF THE INVENTION

An object of the invention claimed herein is to provide a range of authority for an air/fuel feedback control system which is adaptively learned and thereby maximized under all operating conditions.

The above object is achieved, and problems of prior approaches overcome, by an air/fuel feedback control system and method for an internal combustion engine as claimed herein. In one particular aspect of the invention, the method comprises the steps of providing an adjustment for fuel flow delivered to the engine in response to a first and a second feedback variable to maintain a desired air/fuel ratio; generating the first feedback variable by integrating an output of an exhaust gas oxygen sensor positioned in the engine exhaust; generating the second feedback variable from the first feedback variable to force the first feedback variable towards a desired feedback value; and limiting the first feedback variable by a limit value related to the second feedback variable.

An advantage of the above aspect of the invention is that limits placed on the first feedback variable are adaptively learned from the second feedback variable thereby maximizing the range of authority of the air/fuel control method.

BRIEF DESCRIPTION OF THE DRAWINGS

The object and advantages described herein will be more fully understood by reading an example of an embodiment in which the invention is used to advantage, referred to herein as the Description of the Preferred Embodiment, with reference to the drawings wherein.

DESCRIPTION OF AN EMBODIMENT

Figure 1:
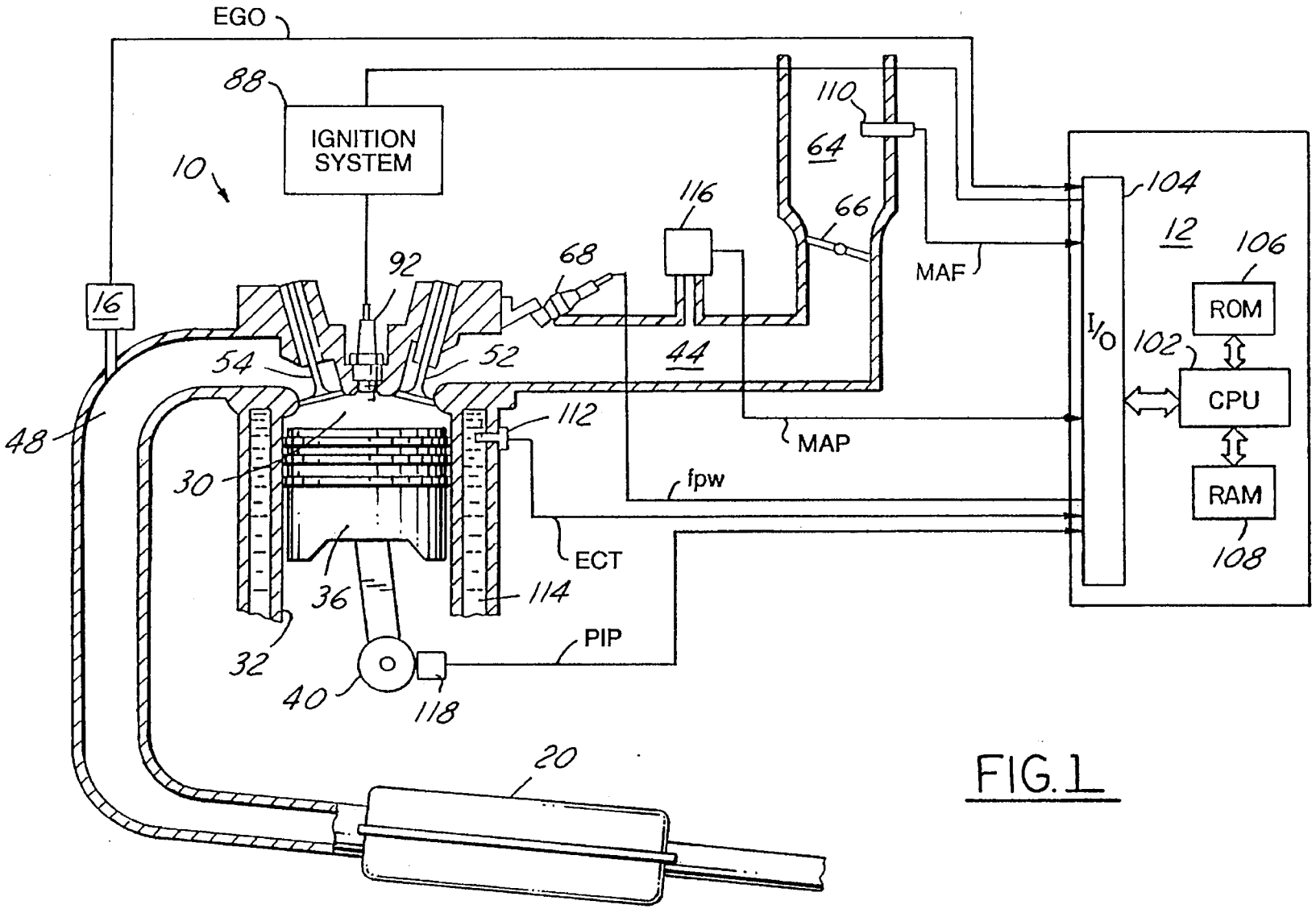
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Catalytic type exhaust gas oxygen sensor 16 is shown coupled to exhaust manifold 48 of engine 10 upstream of catalytic converter 20. Sensor 16 provides signal EGO to controller 12 which converts it into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected as stoichiometry which falls within the peak efficiency window of catalytic converter 20. In general terms which are described later herein with particular reference to FIGS. 2–5, controller 12 provides engine air/fuel feedback control in response to signals EGOS.

Continuing with FIG. 1, engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54.

Intake manifold 44 is shown communicating with throttle body 64 via throttle plate 66. Intake manifold 44 is also shown having fuel injector 68 coupled thereto for delivering liquid fuel in proportion to the pulse width of signal fpw from controller 10. Fuel is delivered to fuel injector 68 by a conventional fuel system (not shown) including a fuel tank, fuel pump, and fuel rail (not shown).

Conventional distributorless ignition system 88 provides ignition spark to combustion chamber 30 via spark plug 92 in response to controller 12.

Controller 12 is shown in FIG. 1 as a conventional microcomputer including: microprocessor unit 102, input/output ports 104, electronic memory chip 106 which is an electronically programmable memory in this particular example, random access memory 108, and a conventional data bus. Controller 12 is shown receiving various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling sleeve 114; a measurement of manifold pressure (MAP) from manifold pressure sensor 116 coupled to intake manifold 44; and a profile ignition pickup signal (PIP) from Hall effect sensor 118 coupled to crankshaft 40.

Figure 2:
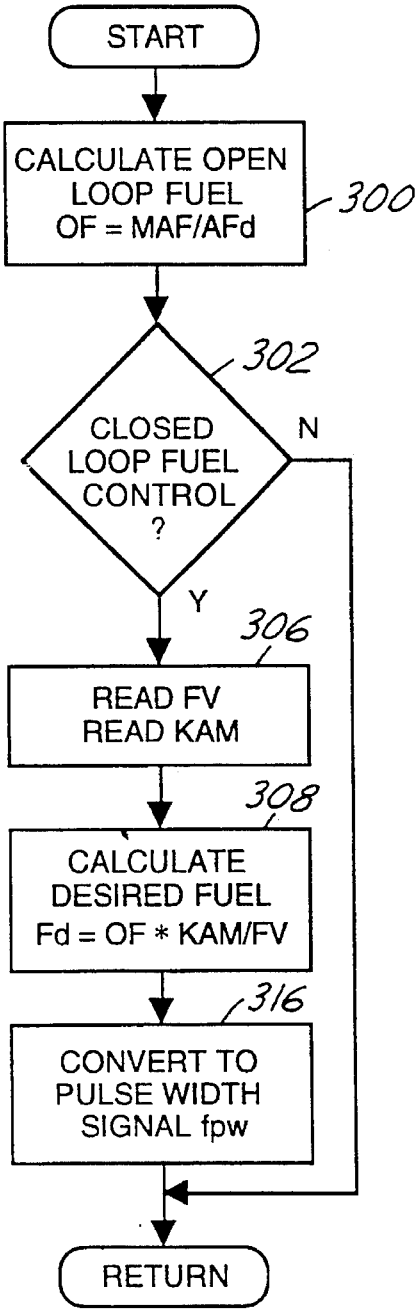
FIGS. 2–5 are flowcharts showing processes performed by a portion of the embodiment shown in FIG. 1.

The liquid fuel delivery routine executed by controller 12 for controlling engine 10 is now described beginning with reference to the flowchart shown in FIG. 2. An open loop calculation of desired liquid fuel (signal OF) is calculated in step 300. More specifically, the measurement of inducted mass airflow (MAF) from sensor 110 is divided by desired air/fuel ratio AFd which, in this example, is correlated with stoichiometric combustion.

A determination is made that closed loop or feedback control is desired (step 302) by monitoring engine operating parameters such as temperature ECT. Feedback variable FV and learned feedback correction KAM are then read from the subroutines described later herein with reference to FIGS. 4 and 5, respectively. Desired fuel quantity, or fuel command, for delivering fuel to engine 10 is generated by dividing feedback variable FV into the product of previously generated open loop calculation of desired fuel (signal OF) and learned feedback correction KAM as shown in step 308.

Fuel command or desired fuel signal Fd is then converted to pulse width signal fpw (step 316) for actuating fuel injector 68.

Controller 12 executes an air/fuel feedback routine to generate feedback variable FV as now described with reference to the flowchart shown in FIG. 3. Initial conditions which are necessary before feedback control is commenced, such as temperature ECT being above a proselected value, are first checked in step 500.

Figure 3:
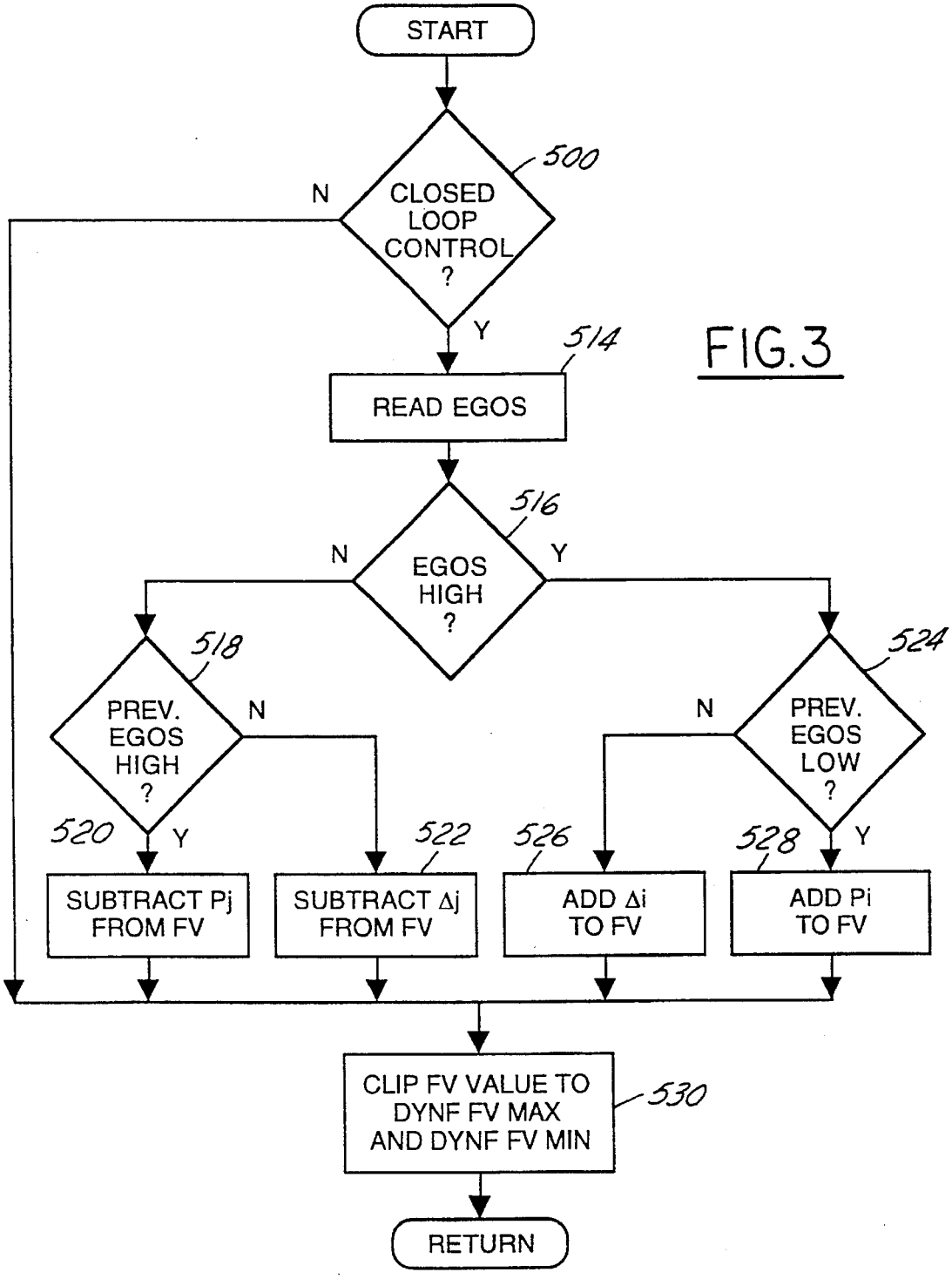

Continuing with FIG. 3, when signal EGOS is low (step 516), but was high during the previous background loop of controller 12 (step 518), preselected proportional term Pj is subtracted from feedback variable FV (step 520). When signal EGOS is low (step 516), and was also low during the previous background loop (step 518), proselected integral term Δj, is subtracted from feedback variable FV (step 522).

Similarly, when signal EGOS is high (step 516), and was also high during the previous background loop of controller 12 (step 524), integral term Δi is added to feedback variable FV (step 526). When signal EGOS is high (step 516), but was low during the previous background loop (step 524), proportional term Pi is added to feedback variable FV (step 528).

In accordance with the above described operation, feedback variable FV is generated each background loop of controller 12 by a proportional plus integral controller (PI) responsive to exhaust gas oxygen sensor 16. The integration steps for integrating signal EGOS in a direction to cause a lean air/fuel correction are provided by integration steps Δi, and the proportional term fbr such correction provided by $P_i$. Similarly integral term Δj and proportional term Pj cause rich air/fuel correction.

Figure 4:
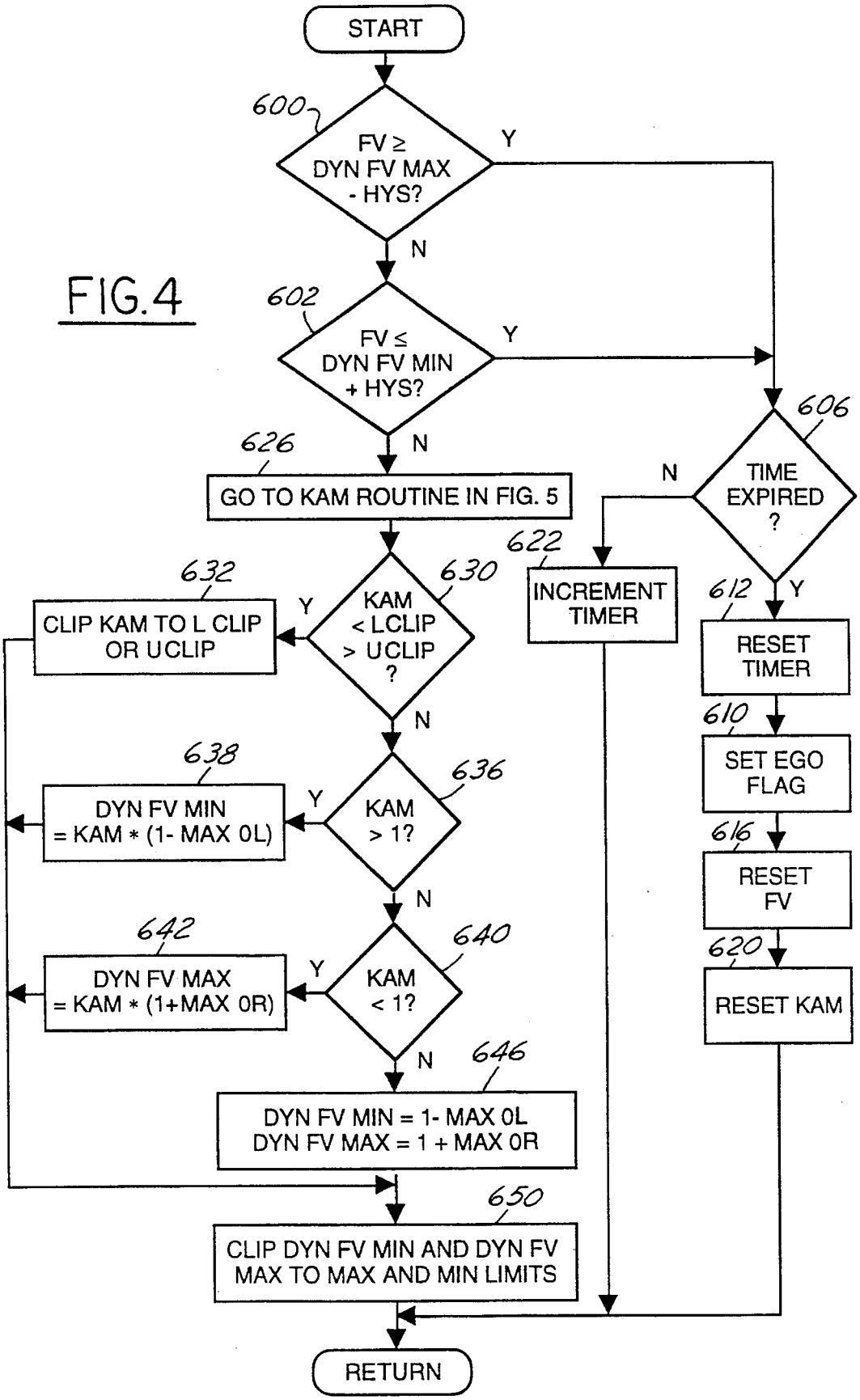

Referring now to FIG. 4, the routine executed by controller 12 for adaptively learning the allowable range of authority for the air/fuel feedback control system is now described. More specifically, the subroutine learns maximum value DYNFVMAX and minimum value DYNFVMIN for feedback variable FV. In this particular example, feedback variable FV is beyond its range of authority when it is either greater than maximum limit DYNFVMAX plus hysterisis value HYS (600), or feedback variable FV is less than minimum value DYNFVMIN less hysterisis value HYS (602). When feedback variable FV has been beyond the above stated range for a predetermined time (606), the EGO sensor FLAG is set (610) indicating service is desired. Concurrently, the timer is reset (612), feedback variable FV reset (616), and learned value KAM reset (620).

When feedback variable FV is within the range of authority provided by steps 600 and 602, the routine for learning feedback correction KAM is entered (626) which is described later herein with particular reference to FIG. 5. Continuing with FIG. 4, however, learned feedback correction KAM is limited to its upper clip value UCLIP or its lower clip value LCLIP in steps 630 and 632. If learned feedback correction KAM is within its upper and lower clip values, but greater than a desired value, minimum learned value DYNFVMIN is set equal to the product of learned feedback correction KAM times the difference between its desired value and operating limit value MAXOL (steps 636 and 638). In this particular example, the desired value of learned feedback correction KAM is unity which is correlated with desired air/fuel ratio Afd. And operating limit MAXOL corresponds to the maximum lean condition engine 10 can tolerate for incurring severe drive problems.

Similarly, when learned feedback correction KAM is within its upper and lower clip values (630), but less than its desired value (640), maximum learned value DYNFVMAX is set equal to the product of learned feedback correction KAM times the sum of unity and maximum rich operating value MAXOR (642). Maximum operating rich value MAXOR indicates the maximum rich air/fuel conditions engine 10 can tolerate before incurring severe drive problems.

When learned feedback KAM is within its clip values (630), and equal to its desired value (636, 640), minimum adaptively learned value DYNFVMIN is set equal to the difference between unity and lean operating limit value MAXOL. Concurrently, maximum adaptively learned value DYNFVMAX is set equal to the sum of unity and maximum rich operating value MAXOR (646). Maximum adaptively learned value DYNFVMAX and minimum adaptively learned value DYNFVMIN are clipped to respective upper and lower limits during step 650.

An advantage of adaptively learning maximum and minimum limits (DYNFVMAX and DYNFVMIN) for the air/fuel feedback control system is that the range of authority for the system is maximized under all operating conditions for both feedback variable FV and learned feedback correction KAM. For example, before feedback learning correction of KAM is enabled, such as after the vehicular battery is disconnected, the entire feedback range of the air/fuel feedback controller is shifted totally to feedback variable FV thereby enabling it to obtain corrections which would not otherwise be obtainable. Stated another way, prior approaches shared the range of authority between both feedback variable FV and learned correction KAM such that neither variable could separately achieve its full range. The adaptive learning of the maximum and minimum ranges as described herein solves that problem and provides the advantage of maximizing the range of authority of the feedback control system.

Figure 5:
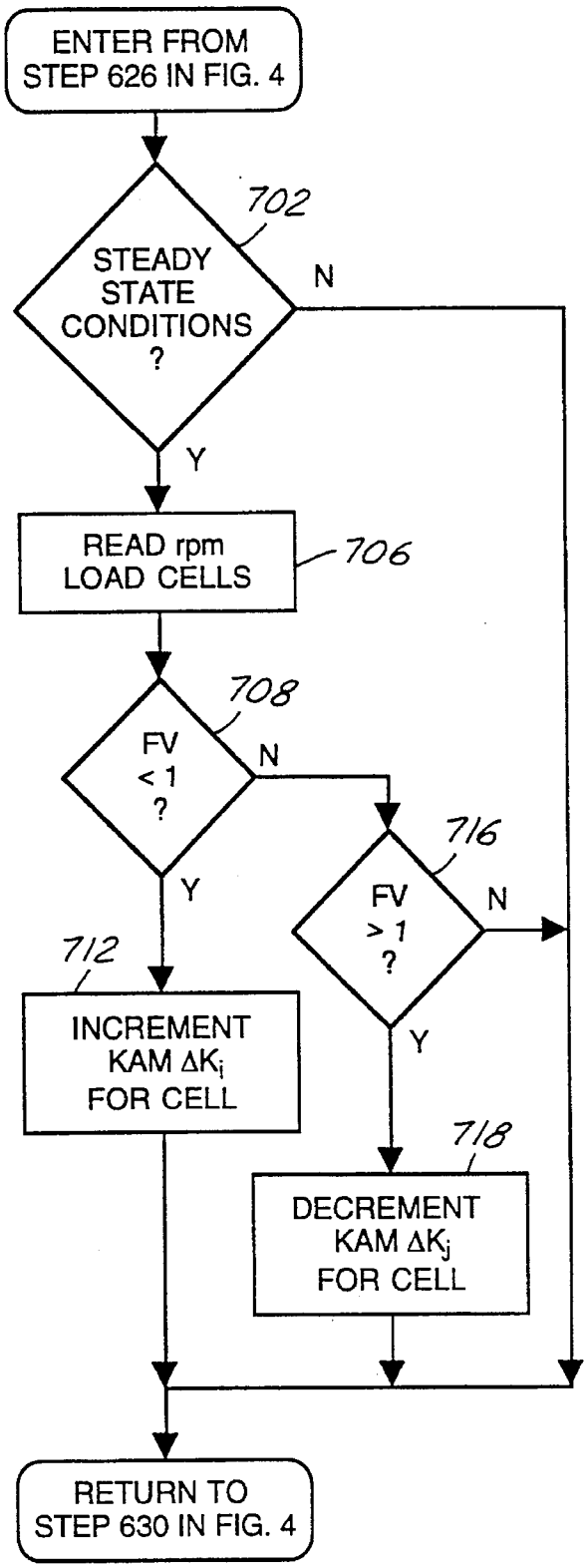

Referring now to FIG. 5, the routine executed by controller 12 for learning feedback correction KAM is now described. In general, feedback correction KAM is learned from the difference between feedback variable FV and its desired value (unity in this particular example) such that learned correction KAM forces feedback variable FV towards its desired value.

As described previously herein, the routine for generating Feedback correction KAM is entered from step 626 in FIG. 4. More specifically, this routine is entered when feedback variable FV is within its range of authority (step 600 and 602 shown in FIG. 4). And, feedback variable FV can be in its range of authority only when periodic switching of EGO sensor 16 is occurring.

Continuing with FIG. 5, learning correction is further enabled when various steady state conditions are achieved (702) such as temperature ECT being above a threshold value. Engine rpm and load are read during step 706 to determine which rpm/load cell engine 10 is operating in. If feedback variable FV is less than its desired value (unity in this example) as shown in steps 708, feedback correction KAM is incremented by amount Δki for the particular engine operating cell.

Similarly, when feedback variable FV is greater than its desired value (716), learned feedback correction KAM is decremented by amount Δkj for the engine operating cell (718). Operation of controller 12 then reverts to step 630 of FIG. 4 wherein the maximum and minimum range (DYNFVMAX and DYNFVMIN) of the air/fuel feedback control system are calculated to maintain the feedback controller range of authority as previously described herein.

This concludes the description of the Preferred Embodiment. The reading of it by those skilled in the art would bring to mind many alterations and modifications without departing from the spirit and scope of the invention. For example, multiple exhaust gas oxygen sensors and air/fuel feedback controllers may be used to advantage such as one for each bank of an engine. Accordingly, it is intended that the scope of the invention be limited by the following claims.

What is claimed:

1. An air/fuel control method for an internal combustion engine, comprising the steps of:

providing an adjustment for fuel flow delivered to the engine in response to a first and a second feedback variable to maintain a desired air/fuel ratio;

generating said first feedback variable by integrating an output of an exhaust gas oxygen sensor positioned in the engine exhaust;

generating said second feedback variable from said first feedback variable to force said first feedback variable towards a desired feedback value; and limiting said first feedback variable by a limit value related to said second feedback variable.

2. The method recited in claim 1 wherein said limiting step provides said limit value as a lean correction limit to limit said first feedback variable when said first feedback variable is providing a lean correction to said fuel flow and said limiting step provides said limit value as a rich correction limit to limit said first feedback variable when said first feedback variable is providing a rich correction to said fuel flow.

3. The method recited in claim 2 wherein said lean correction limit comprises a product of said second feedback variable times a lean limit value and said rich correction limit comprises a product of said second feedback variable times a rich limit value.

4. The method recited in claim 3 wherein said lean limit value comprises a difference between said desired feedback value and a maximum lean fuel flow adjustment and said rich limit value comprises a sum of said desired feedback value and a maximum rich fuel flow adjustment.

5. An air/fuel control method for an internal combustion engine, comprising the steps of:

providing an adjustment for fuel flow delivered to the engine in response to a first and a second feedback variable to maintain the desired air/fuel ratio;

generating said first feedback variable by integrating an output of an exhaust gas oxygen sensor positioned in the engine exhaust;

generating said second feedback variable from said first feedback variable to force said first feedback variable towards a desired feedback value; and limiting said first feedback variable in a lean correction direction to a product of said second feedback variable times a difference between said desired feedback value and a maximum lean fuel flow adjustment and limiting said first feedback variable in a rich correction direction to a product of said second feedback variable times a sum of said desired feedback value and a maximum rich fuel flow adjustment.

6. The method recited in claim 5 wherein said step of generating said second feedback variable further comprises integrating positive integration steps when said first feedback variable is greater than said desired feedback variable and integrating negative integration steps when said first feedback variable is less than said desired feedback variable.

7. The method recited in claim 5 wherein said fuel flow is proportional to a measurement of air inducted into the engine.

8. An electronic memory containing a computer program to be executed by an engine controller which controls an engine having an exhaust gas oxygen sensor in the engine exhaust stream, comprising:

fuel adjustment means for providing an adjustment for fuel flow delivered to the engine in response to a first and a second feedback variable to maintain the desired air/fuel ratio;

first feedback means for generating said first feedback variable by integrating an output of said exhaust gas oxygen sensor;

second feedback means for generating said second feedback variable from said first feedback variable to force said first feedback variable towards a desired feedback value; and limiting means for limiting said first feedback variable in a lean correction direction to a product of said second feedback variable times a difference between said desired feedback value and a maximum lean fuel flow adjustment and limiting said first feedback variable in a rich correction direction to a product of said second feedback variable times a sum of said desired feedback value and a maximum rich fuel flow adjustment.

* * * * *